US005831655A

United States Patent [19]

Asawa et al.

[11] Patent Number: 5,831,655

[45] Date of Patent: Nov. 3, 1998

[54] INK JET RECORDING APPARATUS

[75] Inventors: Hiroshi Asawa; Toshio Kumagai; Toru Fukushima; Eiji Kumai, all of Nagano, Japan

[73] Assignee: Seiko Epson Corporation, Tokyo, Japan

[21] Appl. No.: 619,188

[22] Filed: Mar. 21, 1996

[30] Foreign Application Priority Data

Mar. 23, 1995 [JP] Japan ..... 7-090355
Mar. 24, 1995 [JP] Japan ..... 7-091683

[51] Int. Cl.[6] ..... B41J 2/01

[52] U.S. Cl. ..... 347/102; 347/18; 347/34; 347/89

[58] Field of Search ..... 347/102, 104, 347/18, 34, 89

[56] References Cited

U.S. PATENT DOCUMENTS

| | | | |
|---|---|---|---|
| 4,896,172 | 1/1990 | Nozawa | 347/18 X |
| 5,428,384 | 6/1995 | Richtsmeier | 347/102 |
| 5,528,271 | 6/1996 | Ebisawa | 347/34 |
| 5,552,812 | 9/1996 | Ebinuma | 347/34 |

FOREIGN PATENT DOCUMENTS

| | | | |
|---|---|---|---|
| 0481829 | 4/1992 | European Pat. Off. | B41J 13/00 |
| 0 568 172 | 11/1993 | European Pat. Off. | B41J 2/01 |
| 0568174 | 11/1993 | European Pat. Off. | B41J 2/17 |
| 568 172 | 11/1993 | European Pat. Off. | B41J 2/01 |
| 0622243 | 11/1994 | European Pat. Off. | B41J 29/377 |
| 354-156536 | 12/1979 | Japan | B41J 3/04 |
| 455-084670 | 6/1980 | Japan | B41J 3/04 |
| 57 133073 | 11/1982 | Japan | B41J 3/04 |
| 60 087054 | 9/1985 | Japan | B41J 3/04 |
| 62 111749 | 10/1987 | Japan | B41J 3/04 |
| 62 135374 | 11/1987 | Japan | B41J 3/04 |
| 402-098475 | 4/1990 | Japan | B41J 29/00 |
| 02 251453 | 12/1990 | Japan | B41J 2/01 |
| 5-147204 | 6/1993 | Japan | B41H 2/02 |

OTHER PUBLICATIONS

German Office Action dated Febuary 18, 1996 and translation.

*Primary Examiner*—Joseph W. Hartary
*Attorney, Agent, or Firm*—Sughrue, Mion, Zinn, Macpeak & Seas, PLLC

[57] ABSTRACT

Data is printed on a recording sheet by heating the recording sheet at a pre-printing heating region of a heat roller 20, and the recording sheet is further heated at a post-printing heating and fusing region to thereby be dried and fused. In the meantime, air introduced from an exhaust fan 50 is blown into a data writing section from bottom up in the same direction as a recording sheet feeding direction, so that not only the vapor generated from the recording sheet during the heating and the vapor generated from the ink during the printing are eliminated, but also a recording head 40 is cooled.

10 Claims, 10 Drawing Sheets

INK JET RECORDING APPARATUS

BACKGROUND OF THE INVENTION

1. Field of the Invention

The invention relates generally to an ink jet recording apparatus.

2. Related Art

Ink jet recording apparatuses of such type that data are written by jetting ink droplets onto a recording medium are extensively used as an apparatus providing high quality image at low cost owing to recent technological improvements. However, since it takes some time for the ink deposited on the recording medium to be dried, these recording apparatuses address the problems that the image is scratched in contact with other objects and that ink is blurred depending on the quality of paper used.

To overcome these problems, an improvement has been made. An ink jet recording apparatus disclosed in Unexamined Japanese Patent Publication No. Sho. 59-220385 and the like is designed to forcibly dry the ink by providing a heating source in a platen roller. This apparatus characterized as providing only the heating source still imposes the shortcomings that the quality of the ink is impaired with the ink excessively heated and that the ink droplets jetting operation is disturbed with the recording head heated.

SUMMARY OF THE INVENTION

The invention has been made in view of the aforementioned circumstances. The object of the invention is, therefore, to provide a novel ink jet recording apparatus that can not only dry the ink jetted out onto the recording medium quickly by heat and air stream, but also reliably eliminate negative thermal effects inside the apparatus.

To achieve the above object, the invention is applied to an ink jet recording apparatus that includes: means for upwardly bringing a recording medium into contact with a circumferential surface of a heat roller at a large angle so that the recording medium is heated at a pre-printing heating region and heated and fused at a post-printing heating and fusing region with a data writing region interposed therebetween, the heat roller being heated by a heat source arranged in a center of a shaft thereof; and means for producing an air stream at least at the data writing region in the same direction as a recording sheet feeding direction.

DESCRIPTION OF THE PREFERRED EMBODIMENTS

Figure 1:
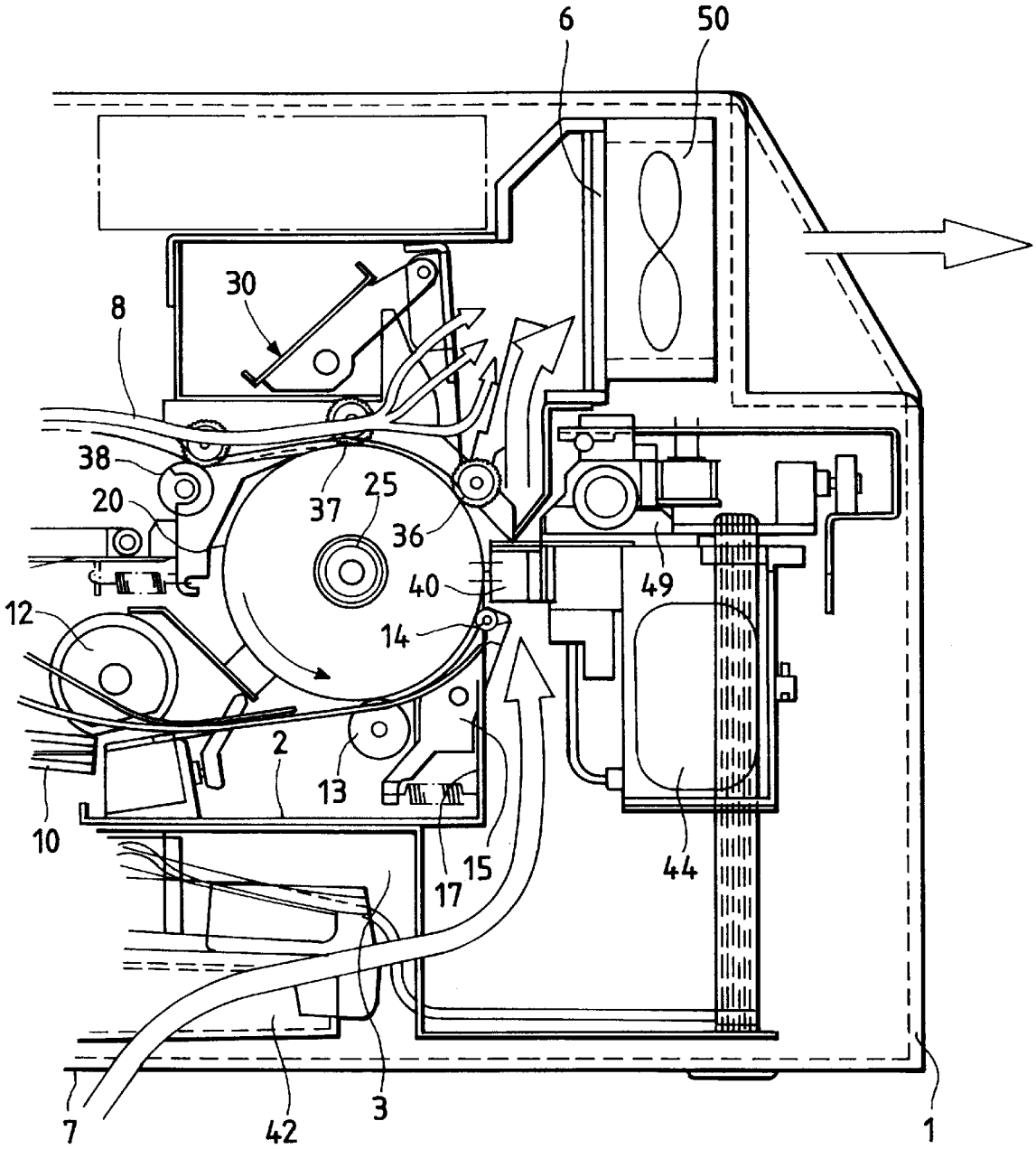
FIG. 1 is a side view showing a main portion of a recording apparatus, which is a first embodiment of the invention.

Embodiments of the invention shown in the drawings will now be described.

FIGS. 1 to 5 show a recording apparatus that is a first embodiment of the invention designed to form color images using various types of color inks containing resin component.

This recording apparatus will be outlined first with reference to FIG. 1.

Inside a casing 1 that covers the recording apparatus are a sheet discharge tray 9 (see FIG. 2) and a sheet feed tray 10. The sheet discharge tray 9 and the sheet feed tray 10 are arranged up and down on one side of the casing with a heat roller 20 being the center of the casing, so that a recording sheet is fed and forwarded in U form from the sheet feed tray 10 to the sheet discharge tray 9 through the heat roller 20. In the upper portion of the other side of the casing 1 is an exhaust fan 50. The exhaust fan 50 not only discharges part of air out of the apparatus via a recording head 40 from below, the air being introduced from a bottom surface opening 7 of the casing 1, but also discharges part of air out of the apparatus so as to flow along a sheet forward path downstream of the recording head 40, the air being introduced from a sheet discharge outlet 8.

The construction of each part of the apparatus will be described in detail.

A sheet feed path extending from the sheet feed tray 10 to the recording head 40 via the lower half portion of the heat roller 20 is partitioned from a lower chamber 3 through a partition wall 2 made of an insulating material. The partition wall 2 is arranged below the sheet feed path in parallel with the sheet feed path. This sheet feed path includes a sheet feed roller 12, a gate roller 13, and sheet biasing rollers 14, so that a recording sheet S piled up on the sheet feed tray 10 is fed onto the circumferential surface of the heat roller 20, and further sent to the recording head 40 via a pre-printing heating region B, which will be described later.

Figure 2:
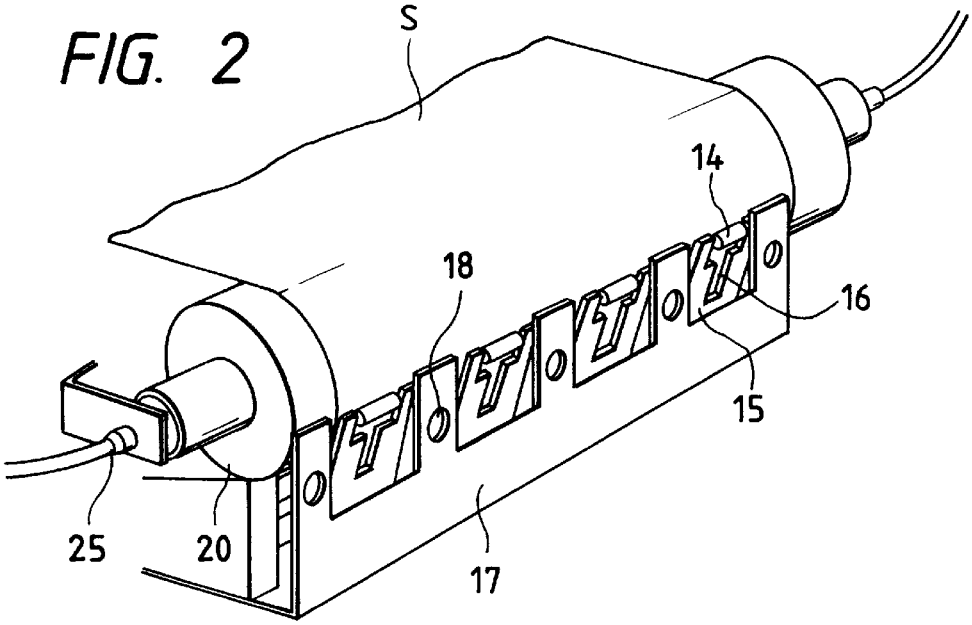
FIG. 2 is a perspective view showing a bedewing prevention mechanism of the apparatus shown in FIG. 1.

On the other hand, a comb-like sheet biasing plate 17 for biasing the recording sheet S onto the circumferential surface of the heat roller 20 is arranged where the sheet biasing rollers 14 are located as shown in FIG. 2. The sheet biasing plate 17 suppresses the floating of the head end of the recording sheet S at a position immediately before the recording head 40 together with the sheet biasing rollers 14 arranged on ends of sheet biasing roller levers 15 and with ends of the sheet biasing plate 17. In addition, each sheet biasing roller lever 15 has an air flow groove 16, and each projecting portion of the comb-like sheet biasing plate 17 has an air flow hole 18, so that vapor generated from the recording sheet S during preheating can be discharged with the bedewing of the vapor being prevented by the air flowing through these air flow portions.

On the other hand, downstream of the recording head 40 are a sheet biasing unit 30 that will be described later, several knurled rollers 36, 37 that are arranged on the sheet biasing unit 30, and a pair of sheet discharge rollers 38. These members cooperate in discharging the recording sheet S from the data writing section toward the sheet discharge tray 9.

Figure 3:
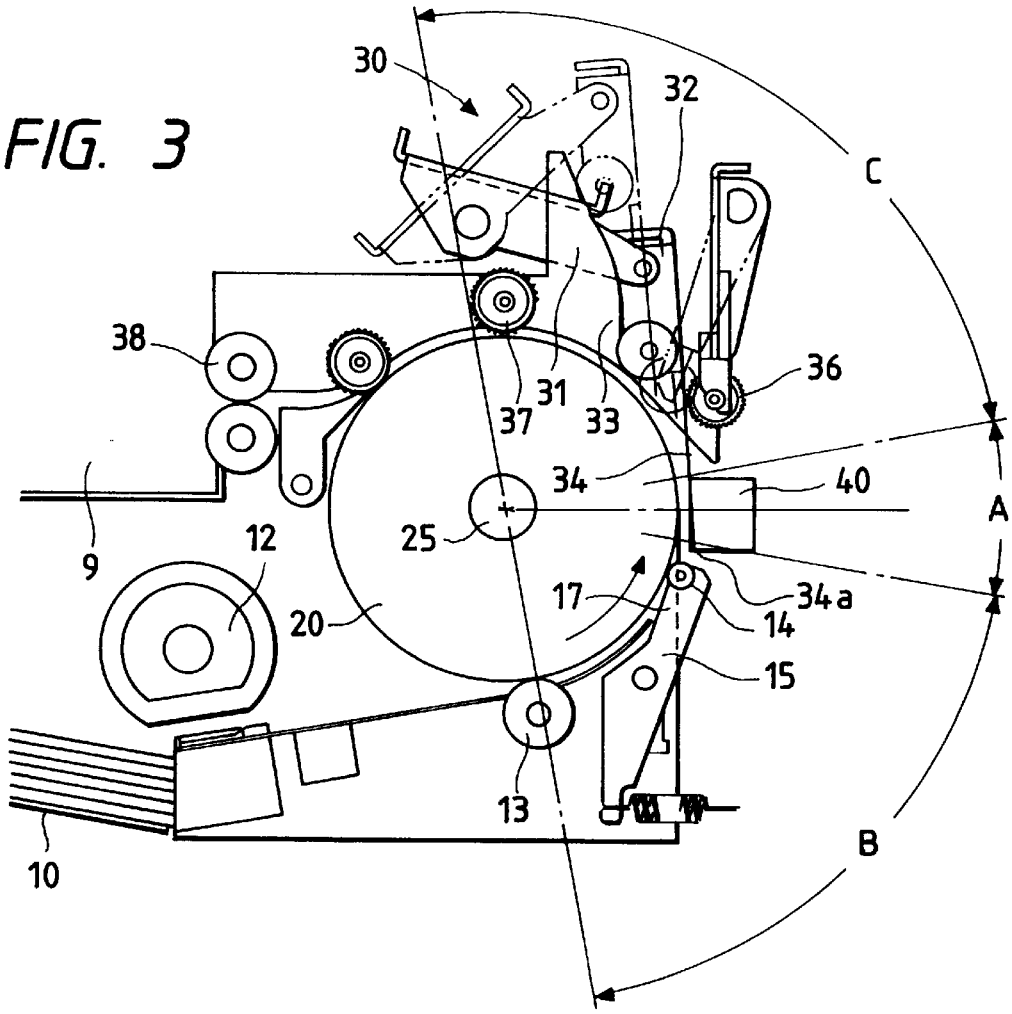
FIG. 3 is a side view showing a heat roller portion of the apparatus shown in FIG. 1.

By the way, although not shown in the drawings, the aforementioned heat roller 20 is designed to rotate counter-clockwise as viewed in FIG. 2 by a roller drive motor through an intermediate gear meshed with a heat roller gear fixed to a shaft end of the heat roller 20. Further, the heat roller 20 has a halogen lamp 25 in the center shaft portion so that the lamp 25 serves as a heat source. As shown in FIG. 3, the heat roller 20 receives heat radiating from the halogen lamp 25, so that the recording sheet S is heated at the following regions of the heat roller 20. An on-printing heating region A confronts the recording head 40 and subtends a central angle of about 20°. The pre-printing preheating region B is upstream in the rotating direction and subtends a central angle of about 70°. A post-printing heating and fusing region C is downstream in the rotating direction and subtends a central angle of about 90°.

The aforementioned sheet biasing unit 30 rotates from a stand-by position indicated by a solid line in FIG. 3 to a biasing releasing position indicated by a two dot chain line in FIG. 3, and moves the head end of the recording sheet S that has been fed into the data writing section up to the sheet biasing knurled rollers 36 at the same speed as that of the heat roller 20 while biasing the head end of the recording sheet S onto the circumferential surface of the heat roller 20.

That is, by rotating a drive arm 31 that is in the stand-by position (the position indicated by the solid line) to the biasing releasing position (the position indicated by the two dot chain line) by the heat roller gear, an operation arm 32 pivotably supported by an end of the drive arm 31 is moved to a position indicated by a two dot chain line from a position indicated by a solid line along a cam surface 33. Then, an end 34*a* of a thin biasing plate 34 held by the end of the operation arm 32 is moved in the rotating direction while biased onto the circumferential surface of the heat roller 20 from the position at which the end 34*a* is set in the stand-by position with the end 34*a* floating from the data writing section. The end 34*a* of the biasing plate 34 is further moved so as to be moved away at the biasing releasing position, so that the end 34*a* biases the head end of the recording sheet S fed into the data writing section and moves the head end outside the data writing section. Then, the end 34*a* of the biasing plate 34 passes the recording sheet S over to the sheet biasing knurled rollers 36 that have moved to the biasing position.

On the other hand, the recording head 40 is arranged on a horizontal line passing through the axis of the shaft of the heat roller 20 with the nozzle surface thereof being arranged substantially vertical in order to control an excessive increase in temperature due to heat and to prevent nozzles from clogging due to paper powder.

The recording head 40 used in this embodiment has the following nozzle arrangement. Two rows of nozzle arrays for black are arranged on one side of the nozzle surface, and nozzle arrays, each for cyan, magenta, and yellow, are arranged on the other side thereof. Each array extends orthogonal to a recording head travelling direction. The nozzle arrays for black have 32 nozzles arrayed at a density of 180 dpi, and one row of nozzle arrays is half a pitch out-of-phase with the other. Each nozzle array for cyan, magenta, and yellow also has 32 nozzles arrayed at a density of 180 dpi.

This recording head 40 communicates with an aluminum pack 43 through an ink supply tube 41. The aluminum pack 43 is inside an ink cartridge 42 that is accommodated in the lower chamber 3 of the casing 1. The recording head 40 also communicates with a flexible sub tank 44 through a part of the carriage 49. As a result of this construction, the recording head 40 can be cooled by causing the ink to flow between the aluminum pack 43 and the sub tank 44.

Figure 5:
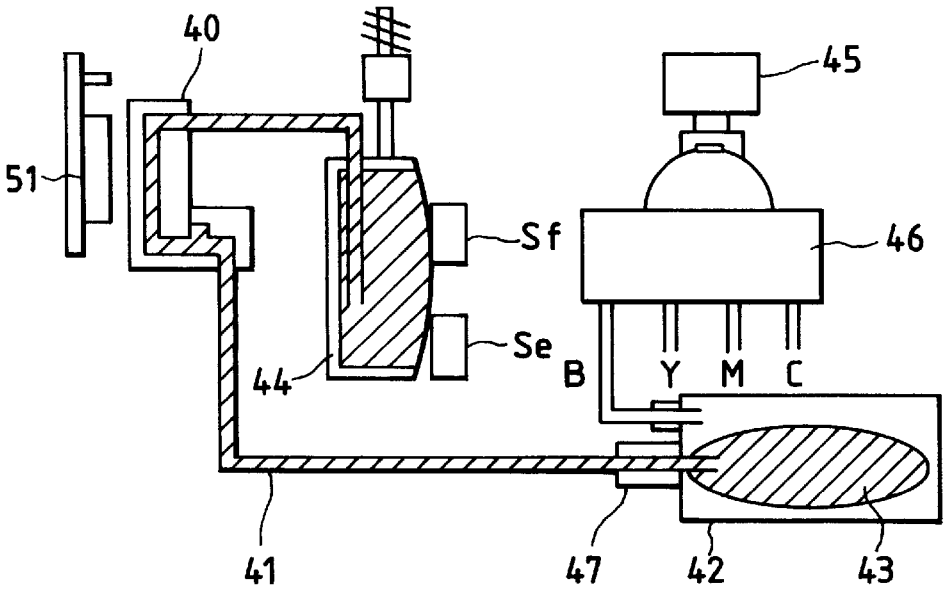
FIG. 5 is a schematic diagram showing a recording head cooling mechanism of the apparatus shown in FIG. 1.

That is, as shown in FIG. 5, an air pump 45 is connected to the ink cartridge 42 through a change-over-valve 46. By increasing pressure within the ink cartridge to, e.g., about 0.06 kg/cm$^2$, the ink within the aluminum pack 43 is fed to the sub tank 44 from the recording head 40 through a needle cap 47, the ink supply tube 41, and a not shown filter. When the sub tank 44 is filled up and this condition is detected by a sensor Sf, the change-over valve 46 is closed, and the ink is returned by taking advantage of a difference in pressure between the sub tank 44 and the ink cartridge 42 with the ink cartridge 42 being equal to atmospheric pressure. Further, when the ink within the sub tank 44 has been used up, the aforementioned operation is repeated to cause the ink to flow to and from by a detection signal from an end sensor Se. As a result of this operation, the recording head 40 is cooled by the ink.

It may be noted that reference numeral 51 in FIG. 5 denotes a cap covering the nozzle surface.

Figure 4:
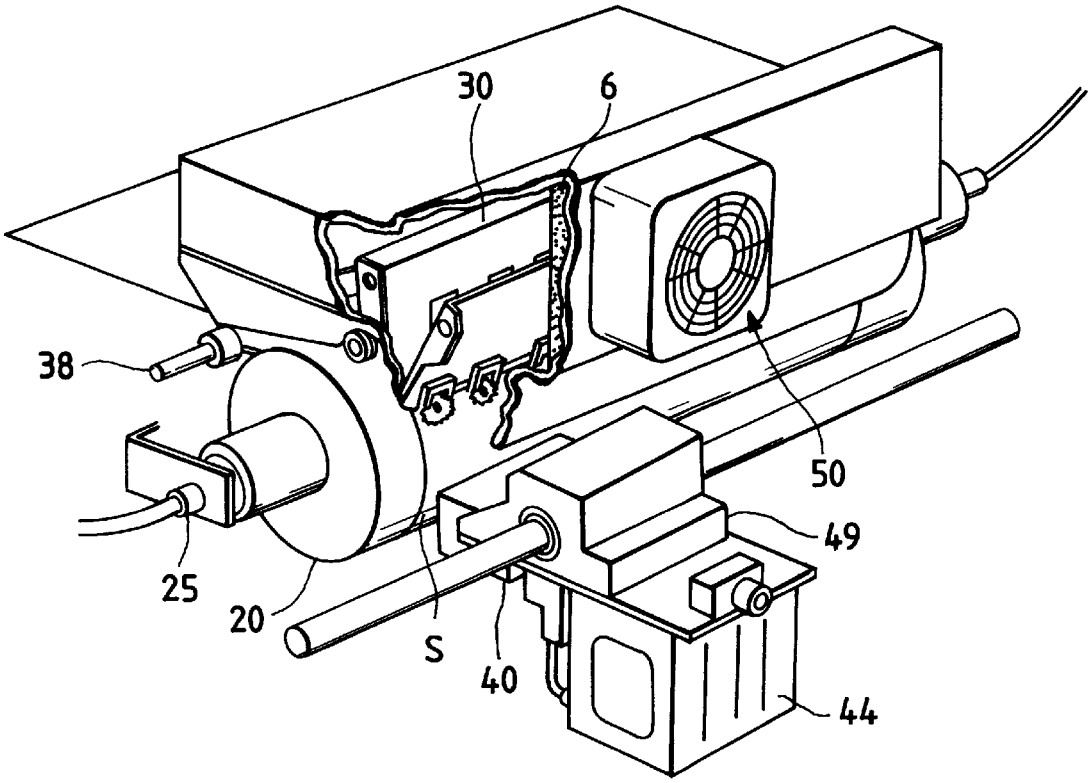
FIG. 4 is a perspective view showing an exhaust fan portion of the apparatus shown in FIG. 1.

By the way, reference numeral 50 in FIG. 4 denotes the exhaust fan for discharging the air whose temperature has been increased within the casing 1. The exhaust fan 50 is attached to a part of an ink mist entrapping filter 6 that extends over one side of the upper portion of the casing 1. The exhaust fan 50 is, therefore, designed to control internal temperature increase by allowing the air introduced from both the bottom surface opening 7 and the sheet discharge outlet 8 to flow through the casing 1 and blow out from one side of the upper portion of the casing 1.

That is, as shown by the arrows whose widths are in proportion to the flowrates, 0.56 m$^3$/min of air and 0.11 m$^3$/min of air are introduced from the bottom surface opening 7 and from the sheet discharge outlet 8 into the casing 1, respectively, in this embodiment so that the ratio of the amount of air introducing from the bottom surface opening 7 to that introduced from the sheet discharge outlet 8 becomes 7 to 9:3 to 1. The ink cartridge 42 within the lower chamber 3 is cooled by the air introduced from the bottom surface opening 7, and such air is thereafter sent to the data writing section at a speed of 2.0 m/sec or less not only to cool the recording head 40 but also to eliminate moisture evaporated from the recording sheet S. Further, the air introduced from the sheet discharge outlet 8 is caused to flow reversely with respect to the recording sheet S forwarded in the sheet discharging direction, so that the recording sheet S is cooled to thereby condense the ink deposited on the recording sheet.

A data writing operation to be performed by the thus constructed apparatus will be described next.

When the recording sheet S is fed onto the circumferential surface of the heat roller 20 from the sheet feed tray 10 by a print command signal from a not shown control circuit, the recording sheet S comes in contact with the heat roller 20 that has been heated to 120° to 130° C. by the heat radiated from the halogen lamp 25, and then reaches the recording head 40 while heated to 100° to 120° C. at the pre-printing preheating region B. During this preheating process, moisture evaporated from the recording sheet S, i.e., 0.25 to 0.28 g of moisture contained in an A4-sized recording sheet under a temperature of 20° C. and a humidity of 60% is sucked by the exhaust fan 50 without bedewing in this heat roller 20 region, and is then driven out of the apparatus by the air flowing through this heat roller region through the air flow grooves 16 on the roller lever 15 or the air flow holes 18 on the sheet biasing plate 17.

On the other hand, the heat of the heat roller 20 increases the temperature of the recording head 40 that confronts the surface of the heat roller 20. The recording head 40 not only comes in contact with the air flowing between the recording head 40 and the heat roller 20 at a speed is 2.0 m/sec or less, but also is subjected to heat transfer effect of the ink that flows between the aluminum pack 43 and the sub tank 44. As a result, temperature increase in the nozzle surface can be contained within 23° C. with respect to room temperature. Hence, defective ink jetting operation due to the drying of the ink jetting surface of each nozzle opening, defective ink jetting operation due to the ink having deposited around the periphery of each nozzle opening caused by deteriorating water repellency of the nozzle opening, and deterioration of strength of the adhesive used in the recording head 40 can be obviated.

When the head end of the recording sheet S is fed into the data writing section under this condition and is inserted under the sheet biasing plate 34 that has been waiting while providing a gap with respect to the heat roller 20, the sheet biasing unit 30 rotates the drive arm 31 upward from the position indicated by the solid line to the position indicated by the two dot chain line and causes the operation arm 32 pivotably supported on the end of the drive arm 31 to elevate along the cam surface 33 to thereby bring the end 34*a* of the sheet basing plate 34 fixed to the operation arm 32 into pressure contact with the circumferential surface of the heat roller 20.

Then, while nipping the head end of the recording sheet S without disturbing the travelling of the recording head 40, the end 34*a* of the sheet biasing plate 34 moves the head end of the recording sheet S downstream of the recording head 40 at the same speed as that of the heat roller 20. Finally, the end 34*a* of the sheet biasing plate 34 moves away from the circumferential surface of the heat roller 20, and thereafter allows the head end of the recording sheet S to be biased by the knurled rollers 36 that have moved to the biasing position in place of the end 34*a*.

Figure 6:
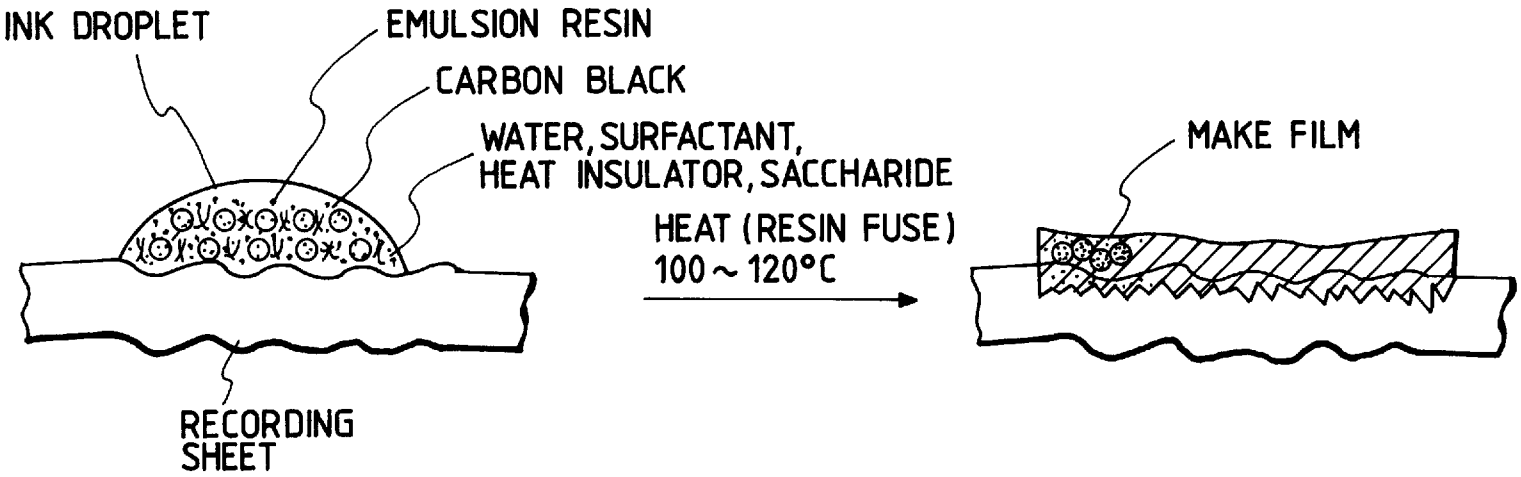
FIG. 6 is a diagram illustrative of a film forming phenomenon of an ink containing resin component.

On the other hand, the recording head 40 jets ink droplets out of the nozzles onto the recording sheet S surface at the on-printing heating region A of the heat roller 20 in the following way. Each ink droplet consists essentially of 1.5% of pigment whose dispersed grain diameter of 100 nm, 10% of saccharide such as MARUCHITORU, 15% of resin component, the grain diameter of styrene acrylic emulsion being 100 nm (at a minimum film making temperature of 80° C.), 6% of a heat insulator consisting of diethylene glycol, 3% of surfactant, and 64.5% of water. The recording head 40 jets such ink droplets out of the nozzles thereof so that these ink droplets can deposit on the recording sheet S surface correctly under an air speed of 2.0 m/sec or less without allowing not only main droplets but also satellite droplets to fly curve. Further, as shown in FIG. 6, the recording head 40 allows the ink droplets to deposit on the recording sheet S by not only decreasing moisture within the ink droplets, but also causing such film forming action that the pigment is closed and contained without bonding particles to one another.

An ink droplet flying test was carried out under the following conditions. Ink droplets, each consisting of a main droplet whose ink weight is 0.03 mg and whose flying speed is 11 m/sec and satellite droplets whose ink weight ranges from 0.005 to 0.015 mg and whose flying speed is 8 m/sec, were jetted onto a recording sheet while air is being blown into a gap of 1.2±0.2 mm (the platen gap) between the platen roller and the nuzzle surface of the recording head with the air flowing speed being varied from one value to another. The following evaluation data were obtained from the test.

TABLE 1

| Air flow speed | Main droplets | Satellite droplets |
|---|---|---|
| 1.0 m/sec | ○ | ○ |
| 1.5 m/sec | ○ | ○ |
| 2.0 m/sec | ○ | Δ |
| 2.5 m/sec | ○ | x |

Note:
○: none is flying curve.
Δ: some are flying curve.
x: all are flying curve.

From the above results, it was found out that the higher the air flowing speed than 2.0 m/sec, or more preferably about 1.7 m/sec, which is the upper limit, the more susceptible the satellite droplets flying curve. The reason is that the satellite droplets among the ink droplets jetted out of the recording head are light in weight and fly at low speeds, so that the satellite droplets are blown away by the air. It was also found out that if the ink weight is reduced to decrease the diameter of each dot formed on the recording sheet so that resolution can be improved, the main droplets do fly curve as well, which is a disadvantage.

During this data writing process, part of the air from the bottom surface opening 7 flows between the recording sheet S and the recording head 40 in the same direction as the recording sheet S feeding direction. Therefore, such air takes the vapor generated from the ink and flowing upward from the recording sheet S with itself to throw the vapor out directly. This means that the vapor does not bedew the nozzle surface, so that defective ink droplet jetting operation and contamination of the image formed on the recording sheet S with stain water or blurring due to the vapor having deposited on the guide surface can be prevented.

On the other hand, the recording sheet S on which data has been written has not only the ink condensed at the post-printing heating and fusing region C, but also is cooled in contact with the air coming from the opposite side during the subsequent forwarding process and discharged onto the sheet discharge tray 9.

FIGS. 7 to 11 show a second embodiment of the invention.

A printer having a sheet biasing unit 110, which is a feature of the invention, will be described first with reference to FIG. 7.

The printer main body 101 is a known printer designed in such a manner that a recording sheet S piled up on a sheet feed tray 102 is sequentially fed toward an opposite side along the surface or a platen roller 103, has data written thereon by a recording head 140, and is thereafter discharged to a sheet discharge tray 105.

Figure 7:
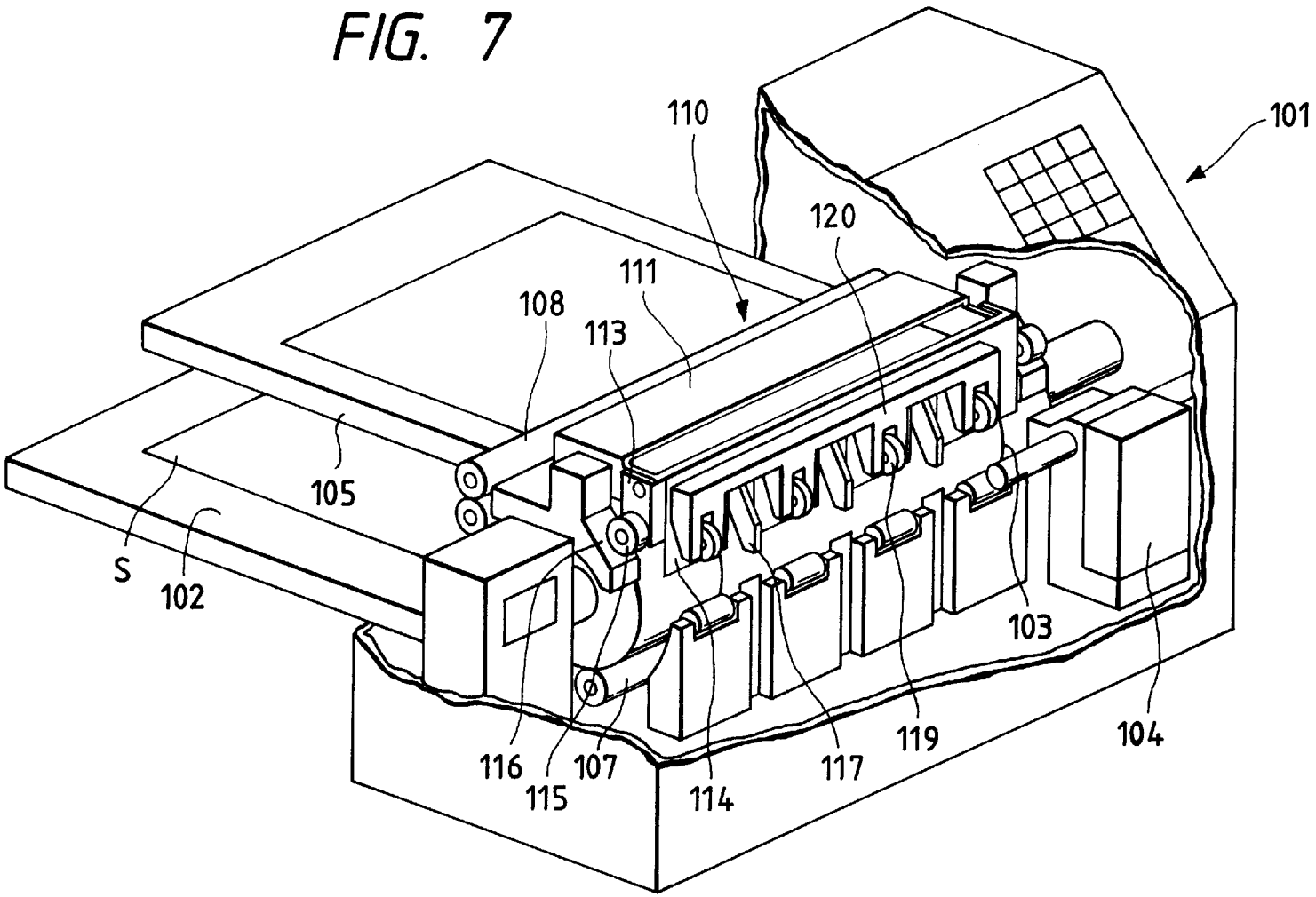
FIG. 7 is a perspective view showing a sheet forward mechanism, which is a second embodiment of the invention.

It may be noted that: reference numeral 106 in FIG. 7 denotes a sheet feed roller; 107, a gate roller; and 108, a sheet discharge roller.

By the way, reference numeral 110 in FIG. 7 denotes the sheet biasing unit that biases the head end of the recording sheet S while interlocking with the sheet feeding operation. This unit 110 includes: a sheet biasing operation means having a drive arm 111 and a driven arm 113, cams 116, and knurled rollers 119. The sheet biasing operation means moves the recording sheet S to a data writing section from downstream of the data writing section while interlocking with the operation of forwarding the recording sheet S to the platen roller 103, allows a sheet biasing plate 114 held by the driven arm 113 to bias the head end of the recording sheet S onto the circumferential surface of the platen roller 103, and releases the biasing of the recording sheet S by evacuating downstream of the data writing region without moving relative to the platen roller 103. The cams 116 are arranged on the printer main body 101 to guide the sheet biasing operation means. The knurled rollers 119 bias the recording sheet S onto the platen roller 103 after the biasing of the recording sheet S by the sheet biasing plate 114 has been released.

Then, the sheet biasing unit 110, which is the feature of the invention, will be described in more detail with reference to FIG. 8.

The sheet biasing unit 110 is arranged at a position immediately after the data writing section in the downstream side, and has the sheet biasing operation means such as the drive arm 111 that interlocks with the operation of the recording head 104.

The drive arm 111 has a length corresponding to the width of the recording sheet S, and is arranged so as to extend in parallel with the circumferential surface of the platen roller 103. Further, the drive arm 11 pivotably supports the driven arm 113 on an end thereof. The driven arm 113 similarly has a length corresponding to the width of the recording sheet S.

The sheet biasing plate 114, which is so thin-walled as to be inserted into a gap between the platen roller 103 and the recording head 104, is arranged on an end of the driven arm 113. On both sides of the driven arm 113 are cam followers 115. The cam followers 115 roll over the surfaces of the corresponding cams 116 fixed on both sides of the printer main body 101, respectively. The cam followers 115 are designed to guide the driven arm 113 when the drive arm 111 has reached the lower pivoting end in such a manner that: an end 114*a* of the sheet biasing plate 114 held by the driven arm 113 is projected slightly toward the upstream side of the data writing section with the end 114*a* floating from the circumferential surface of the platen roller 103; then, the end 114*a* of the sheet biasing plate 114 is returned in the sheet forwarding direction with the end 114*a* being in pressure contact with the circumferential surface of the platen roller 103; and finally, the end 114*a* of the sheet biasing plate 114 is pulled up so that the end 114*a* is moved away from the circumferential surface of the platen roller 103.

Figure 8:
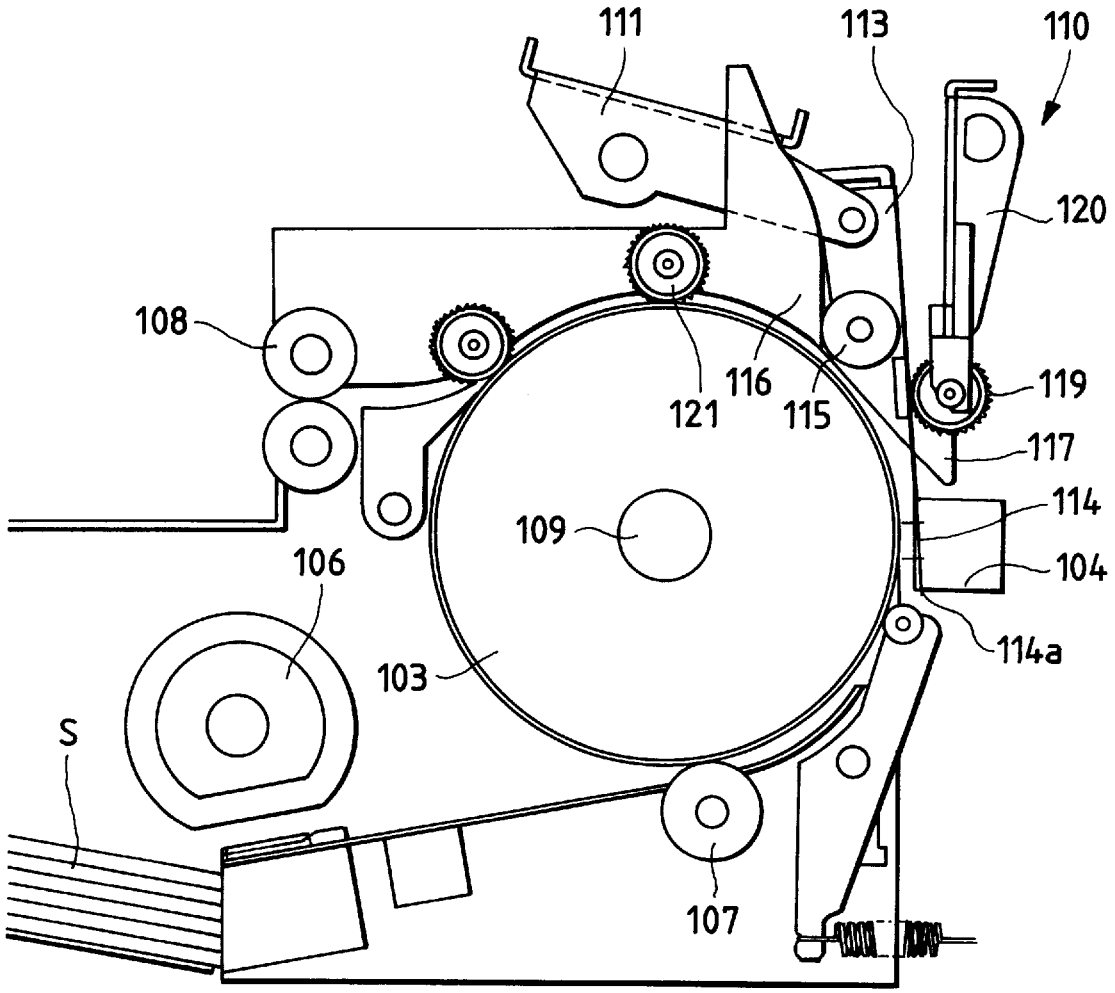
FIG. 8 is a side view showing a main portion of the mechanism shown in FIG. 7 in the stand-by condition.

It may be noted that reference numeral 117 in FIG. 8 denotes a guide piece for guiding recording sheets S when a plurality of recording sheets are erroneously forwarded at once.

Reference numeral 119 in FIG. 8 denotes the knurled rollers. The knurled rollers 119 bring a preceding portion of the recording sheet S biased by the sheet biasing plate 114 into intimate contact with the circumferential surface of the platen roller 103. The knurled rollers 119 are rotatably arranged on an end of a pivotably supported lever 120. When the sheet biasing plate 114 moves in a recording sheet S receiving direction, i.e., downward as viewed in FIG. 8, the knurled rollers 119 move away from the circumferential surface of the platen roller 103 while biased by the surface of the sheet biasing plate 114. When the sheet biasing plate 114 is pulled up so as to move away from the platen roller 103, the knurled rollers 119 rotate in contact with the circumferential surface of the platen roller 103.

It may be noted that reference numeral 121 in FIG. 8 denotes knurled rollers arranged downstream of the sheet biasing unit 110.

A drive mechanism 130 for driving the sheet biasing unit 110 will be described next with reference to FIGS. 10 and 11. The drive mechanism 130 is operated as follows. A platen roller gear 131 arranged on a side opposite to the home position and fixed to an end of the shaft of the platen roller 103 is driven by a platen drive motor 133 through a pinion 132. The rotation of the platen roller gear 131 is transmitted to a drive arm gear 135 through an intermediate gear 134 and then to the drive arm 111 through a torque limiter 136.

Reference numeral 141 denotes a stopper that stops the transmission of the drive force so that the sheet biasing unit 110 is locked in the stand-by position shown in FIG. 8. This bell-crank type stopper 141 whose one end is pivotably supported by a fixed member is designed to block the movement of the driven arm 113 with the other end thereof engaged with the corresponding cam follower 115 positioned in the descending limit end when the stopper 141 has pivoted counterclockwise. Further, the stopper 141 is designed to be operated by an operation lever 144 that is operated through an intermediate lever 143.

On the other hand, an operation piece 149 is integrally arranged on a timing belt 147 at a position substantially squarely opposite to a carriage 148 mounting position so that the recording head 104 is caused to travel in the main scanning direction. The timing belt 147 is driven by a carriage motor 146. The operation lever 144 that is pivotably supported with one end thereof facing within the range of movement of the operation piece 149 is pivoted to an unlocked position (the position indicated by a two dot chain line).

Figure 9C:
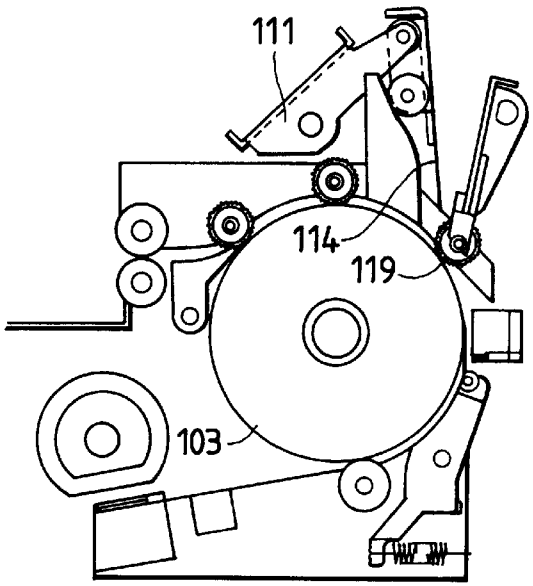
FIGS. 9A, 9B and 9C are diagrams showing operations of the mechanism shown in FIG. 7 in the print start condition, in the biasing start condition, and in the biasing released condition.

An operation of the thus constructed sheet forward mechanism will be described with reference to FIGS. 8 and 9.

The drive arm 111 driven by the drive arm gear 135 through the torque limiter 136 not only is set in the clockwise rotating end position as viewed in FIG. 8 under the stand-by condition shown in FIG. 8, but also sets the driven arm 113 pivotably supported on the end thereof in the descending limit. In addition, as shown in FIG. 10, the drive arm 111 is stopped in this position with the cam follower 115 locked by the stopper that has been pivoted counterclockwise as viewed in FIG. 10.

Under this condition, the driven arm 113 sets the end 114*a* of the sheet biasing plate 114 held thereby in a position slightly upstream of the data writing region, and takes the position for receiving the head end of the recording sheet S by causing the end 114*a* to float slightly from the circumferential surface of the platen roller 103.

Figure 10:
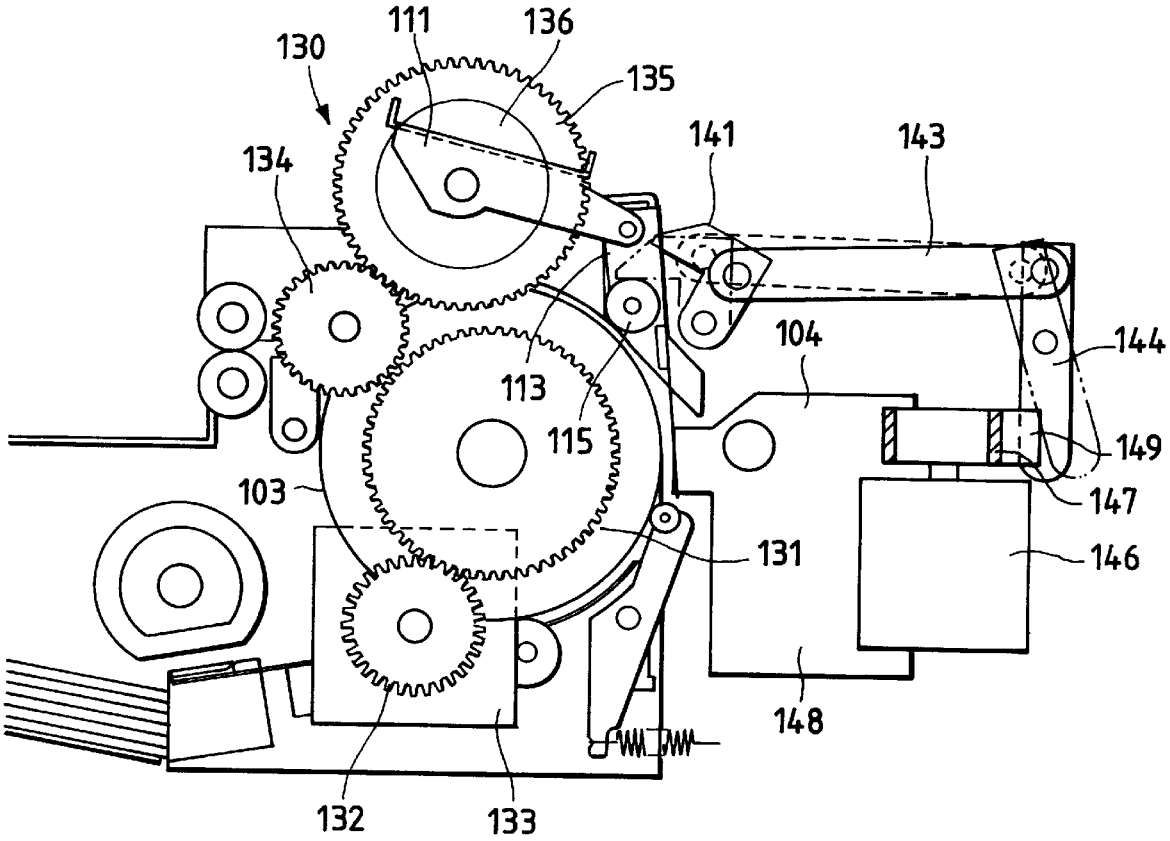
FIG. 10 is a side view showing a sheet biasing unit drive mechanism.
Figure 11:
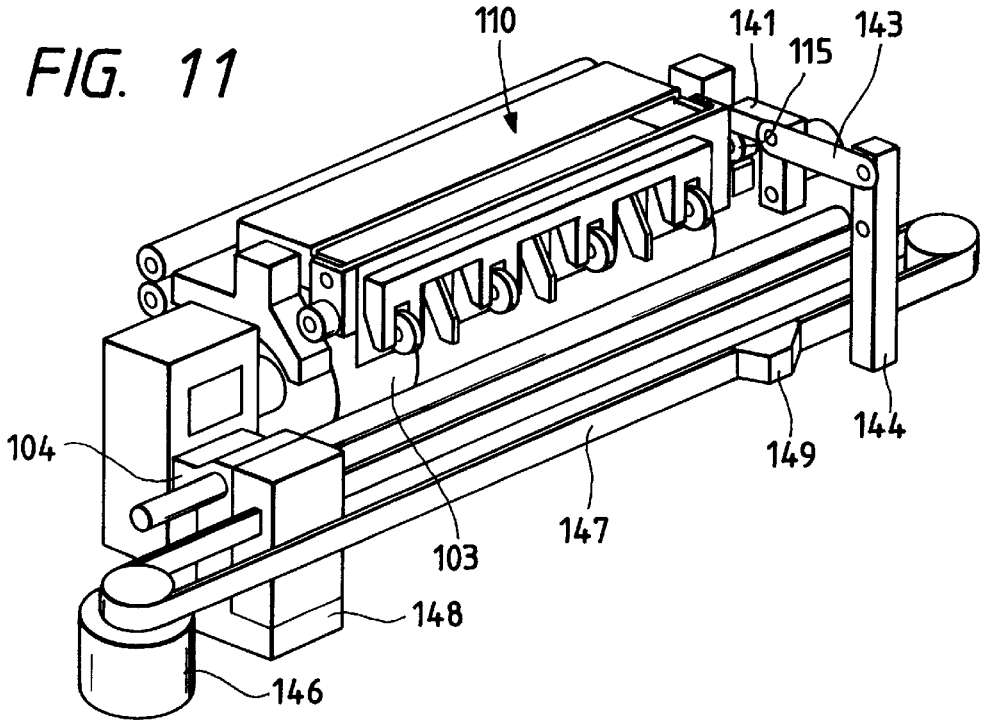
FIG. 11 is a perspective view showing the sheet biasing unit drive mechanism.

Therefore, when the sheet feed roller 6 that has been activated by a data writing signal pulls out the recording sheet S on the sheet feed tray 102 and feeds such recording sheet S onto the circumferential surface of the platen roller 103 under this condition, the carriage motor 140 that has started rotating in synchronism with the sheet feeding operation moves the timing belt 147 slightly forward and backward and moves the operation piece 149 fixed to the opposite side together with the carriage 148 that is standing by in the home position, so that the operation lever 144 projecting into the operation piece 149 movement range is pivoted in the position indicated by a solid line in FIG. 10. As a result, the stopper 141 is pivoted clockwise through the intermediate lever 143 to thereby unlock the corresponding cam follower 115.

Figure 9B:
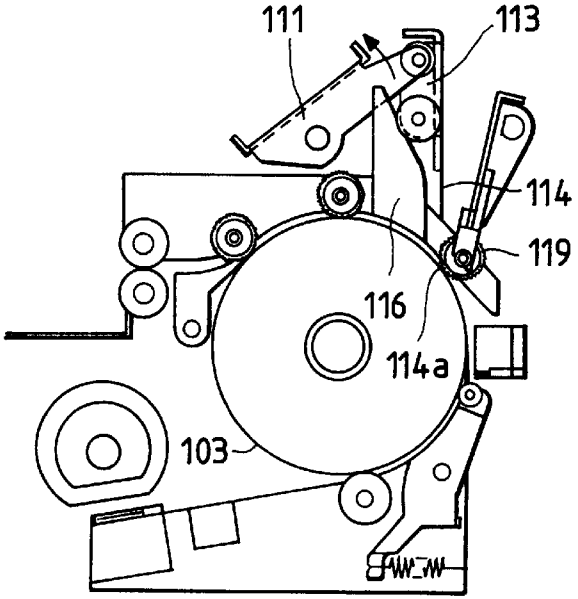
Figure 9A:
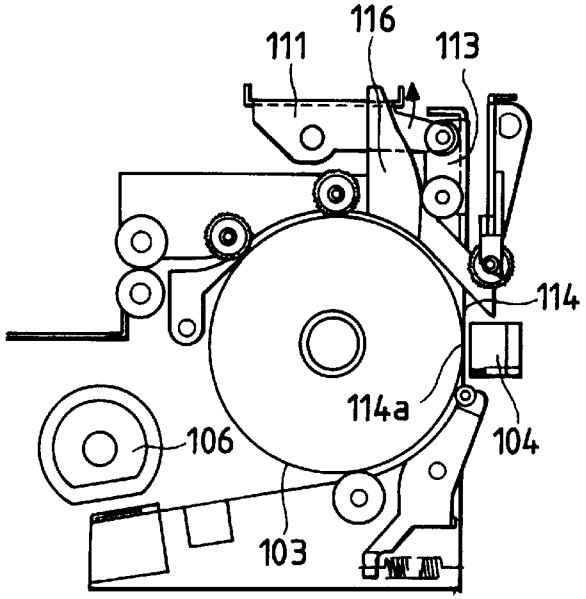

Hence, the drive arm 111 that has been unloaded rotates counterclockwise as shown in FIG. 9A while driven by the drive arm gear 135, elevates the driven arm 113 pivotably supported by the end thereof along the surfaces of the cams 116, and pulls up the sheet biasing plate 114 held by the driven arm 113 until the end 114*a* of the sheet biasing plate 114 reaches a position about 1 mm upstream of the data writing section. At this point, the head end of the recording sheet S that has been forwarded into the data writing section is biased at a position about 102 mm from the top of the recording sheet onto the circumferential surface of the platen roller 103 by bringing the end 114*a* into pressure contact with the circumferential surface of the platen roller 103.

In the meantime, the recording head 104 that has been set in the home position performs a predetermined data writing operation on the recording sheet S while ensuring a print top margin, as short as 2 mm+1 mm from the head end of the sheet by travelling over the recording sheet S without being disturbed by the sheet biasing plate 114 whose thickness is, e.g., as thin as 0.2 mm or so.

When the drive arm 111 is further rotated counterclockwise as viewed in FIG. 9A through the torque limiter 136 so that the platen roller 103 and the sheet biasing plate 114 will not move relative to each other in this way, the driven arm 113 pulls up the sheet biasing plate 114 held thereby while guided by the surfaces of the cams 116 from the circumferential surface of the platen roller 103, and moves the knurled rollers 119 so as to come in contact with the circumferential surface of the platen roller 103 to thereby cause the knurled rollers to bias a portion of the recording sheet S immediately after the portion of the recording sheet S biased by the sheet biasing plate 114 as shown in FIG. 9B.

When the sheet biasing plate 114 is moved away from the circumferential surface of the platen roller 103 by successive rotation of the drive arm 111 in the counterclockwise direction, the knurled rollers 119 bring the recording sheet S into contact with the circumferential surface of the platen roller 103 while rolling over the recording sheet S to allow the data writing operation to be continued.

While the foregoing relates to an embodiment in which the sheet forward mechanism is applied to an ink jet printer that performs data writing operation while heating the platen roller 103 with a halogen lamp 109 arranged in the center of the shaft, it goes without saying that the sheet forward mechanism is applicable to ordinary printers.

This embodiment is also designed to operate the sheet biasing unit 110 by causing the operation lever 144 to be moved by the operation piece 149 mounted on a portion of the timing belt 147 opposite to the carriage 148. This design dispenses with a special actuator and, in addition, allows the sheet biasing unit 110 to be operated easily even if the unit 110 is arranged in a position opposite to the home position.

Figure 12:
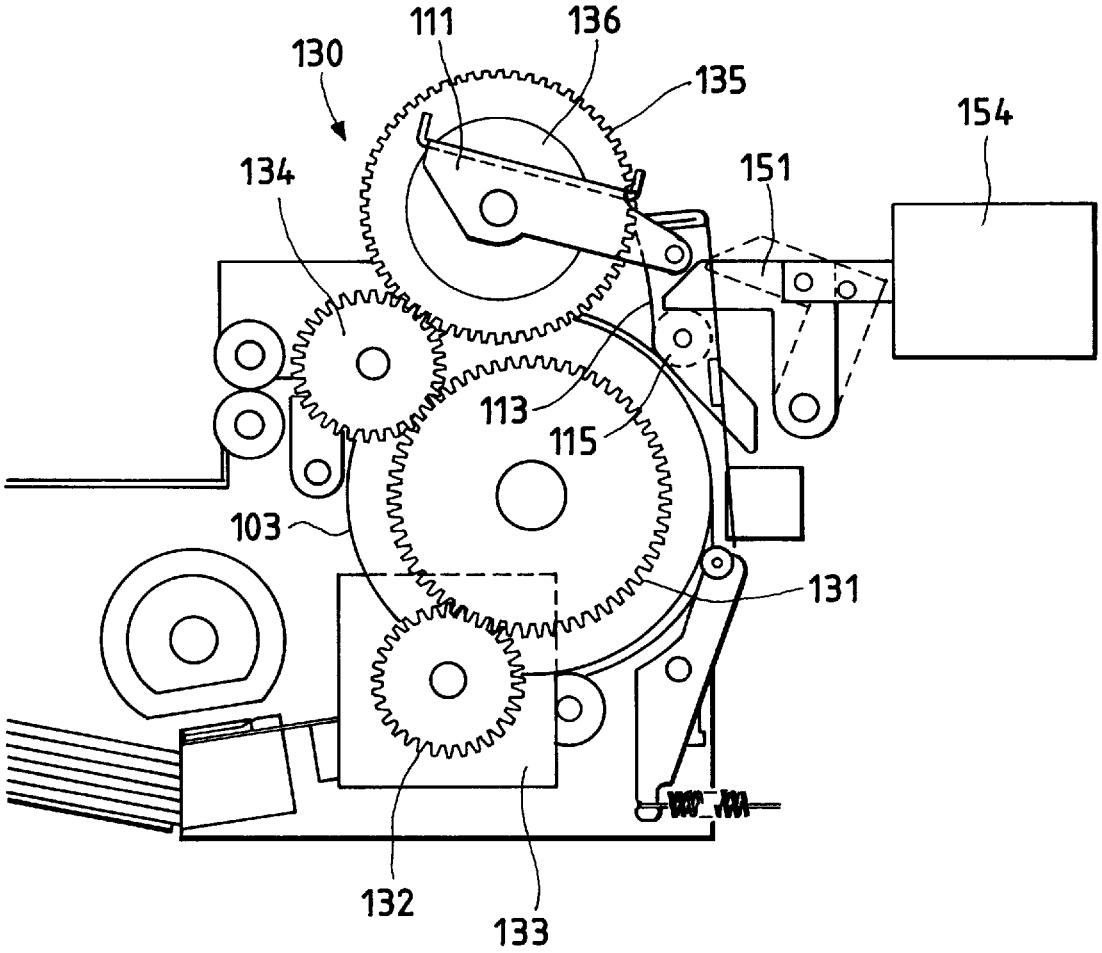
FIG. 12 is a side view showing a sheet biasing unit drive mechanism, which is a third embodiment of the invention.

On the other hand, FIG. 12 shows a third embodiment of the invention, which relates to a sheet biasing unit 110 driving operation means.

The third embodiment is characterized as arranging a unit operating solenoid 154 in place of the operation lever 144 in the second embodiment. By moving a bell-crank type stopper 151 to a position indicated by the two dot chain line and to a position indicated by a solid line in FIG. 12, the stopper 151 is engaged with and disengaged from the corresponding cam follower .115 on the driven arm 113 to thereby operate the sheet biasing unit 110. As a result of this embodiment, the structure of the sheet forward mechanism can be simplified significantly only by using the solenoid 154.

Figure 13:
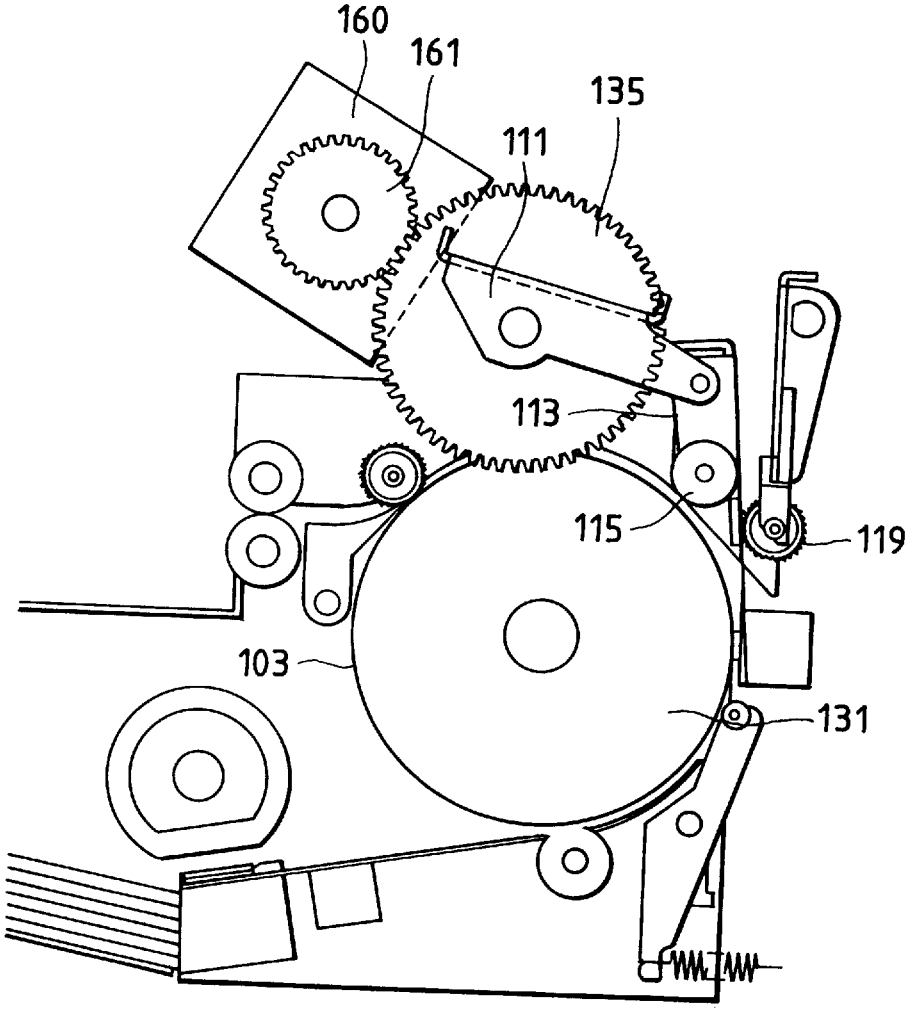
FIG. 13 is a side view showing a sheet biasing unit drive mechanism, which is a fourth embodiment of the invention.

Further, FIG. 13 shows a fourth embodiment of the invention, which relates to a sheet biasing unit 110 driving operation means. The fourth embodiment is characterized as not only arranging a drive motor 160 dedicated to driving the sheet biasing unit 110 inside the printer main body, but also operating the drive motor 160 based on a preset program so that the movement of the drive motor 160 is transmitted to the drive arm 111 through the drive arm gear 135 meshed with a pinion 161 of the motor shaft to thereby allow the sheet biasing plate 114 to perform the operation shown in FIGS. 7 and 8.

Although the fourth embodiment, requiring the dedicated drive motor 160, is disadvantageous in terms of cost, the fourth embodiment is advantageous in not only allowing the head end of the sheet to be biased at all times independently of whether the platen roller 103 is driven or not, but also allowing sheet feed and discharge time during the continuous printing operation to be shortened significantly.

While the foregoing describes the invention with an ink jet recording apparatus using resin-containing inks taken as an example, it goes without saying that the invention may also be applied to ink jet recording apparatuses using ordinary inks.

As described in the foregoing, the invention is characterized as arranging a means for feeding a recording medium upward onto the circumferential surface of a heat roller at a large contact angle so that pre-printing heating and post-printing heating can be implemented. Therefore, the ink droplets jetted out onto the recording medium can be dried and fused immediately. The invention is further characterized as arranging a means for causing air to flow in the same direction as the recording medium feeding direction. Therefore, not only the vapor generated from the recording medium at the time of pre-printing heating and the vapor generated from the ink at the time of data writing can be eliminated efficiently by taking advantage of the rising behavior of the vapor, but also the recording head can also be effectively cooled.

What is claimed is:

1. An ink jet recording apparatus comprising:

a casing;

a heat roller being heated by a heat source arranged in a center of a shaft of said heat roller;

means for data writing on a recording medium;

means for upwardly bringing the recording medium into contact with a circumferential surface of said heat roller at a large angle so that the recording medium is heated at a pre-printing heating region and is heated and fused at a post-printing heating and fusing region with a data writing region interposed between said pre-printing heating region and said post-printing heating and fusing region;

air stream producing means for producing a first air stream at said data writing region in a same direction as a recording medium feeding direction, said air stream producing means causing the first air stream to exit the ink-jet apparatus;

a bottom opening formed in said casing, for allowing said first air stream to flow into said casing;

said air stream producing means producing a second air stream through a recording medium discharge portion, said recording medium discharge portion formed on a first side of said casing for discharging the recording medium, wherein the second air stream flows into said casing in the reverse direction of said recording medium discharge direction; and an exhaust fan located above said heated roller at a second side opening of said casing, wherein the first air stream flowing from said bottom opening and the second air stream flowing from said sheet discharging portion flow toward said exhaust fan to be discharged out of said casing together through said second side opening.

2. An ink jet recording apparatus according to claim 1, wherein a speed of said air flowing through the data writing region is set to 2.0 m/sec or less.

3. An ink jet recording apparatus according to claim 1, wherein said air stream producing means comprises an exhaust fan; and means for eliminating ink mists being discharged on at least one of an air entrance and an air exit of said exhaust fan.

4. An ink jet recording apparatus according to claim 1, wherein a recording head is arranged on a substantially horizontal line passing through an axis of said shaft of said heat roller so that a nozzle surface thereof extends in substantially the same direction as a direction of the second air stream.

5. An ink jet recording apparatus according to claim 4, wherein said recording head is arranged along an ink flow path connecting an ink supply cartridge to a sub tank; and means for causing an ink to flow between said ink supply cartridge and said sub tank.

6. An ink jet recording apparatus according to claim 5, wherein said ink supply cartridge is arranged below said heat roller having a heating source through an insulating member.

7. An ink jet recording apparatus according to claim 5, wherein said subtank has a sensor for detecting the amount of ink in said sub tank.

8. An ink jet recording apparatus according to claim 1, wherein an air flow path for discharging moisture produced from the recording medium is arranged upstream of said data writing section of said heat roller.

9. An ink jet recording apparatus according to claim 1, wherein said means for producing an air stream includes an air flow groove and an air flow hole for the first air stream flowing in the same direction as the recording medium feeding direction.

10. An ink jet recording apparatus comprising:

a heat roller being heated by a heat source arranged in a center of a shaft of said heat roller;

means for data writing on a recording medium;

means for upwardly bringing the recording medium into contact with a circumferential surface of said heat roller at a large angle so that the recording medium is heated at a pre-printing heating region and is heated and fused at a post-printing heating and fusing region with a data writing region interposed between said pre-printing heating region and said post-printing heating and fusing region; and means for Producing an air stream at said data writing region in a same direction as a recording medium feeding direction, said air stream producing means causing the air stream to exit the ink-jet apparatus, wherein the recording medium is discharged from the apparatus via a recording medium discharge path and a ratio of an amount of air flowing through said data writing region to an amount of air flowing through said recording medium discharge path is set to 7 to 9 : 3 to 1, wherein the air flowing through said recording medium discharge path flows in a reverse direction as the recording medium feeding direction.

* * * * *